US008014698B2

(12) United States Patent
Kim

(10) Patent No.: US 8,014,698 B2
(45) Date of Patent: Sep. 6, 2011

(54) IMAGE FORMING APPARATUS

(75) Inventor: Young-min Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 31 days.

(21) Appl. No.: 12/247,381

(22) Filed: Oct. 8, 2008

(65) Prior Publication Data

US 2009/0274483 A1 Nov. 5, 2009

(30) Foreign Application Priority Data

Apr. 30, 2008 (KR) ..... 10-2008-0040530

(51) Int. Cl.
*G03G 15/00* (2006.01)

(52) U.S. Cl. ..... 399/107; 399/110; 399/111; 399/119

(58) Field of Classification Search ..... 399/107, 399/110, 111, 119, 120, 121, 124, 125, 302
See application file for complete search history.

(56) References Cited

U.S. PATENT DOCUMENTS

| | | | | |
|---|---|---|---|---|
| 6,091,912 | A * | 7/2000 | Kitajima et al. | 399/13 |
| 2006/0210307 | A1 | 9/2006 | Katoh et al. | |
| 2007/0059033 | A1 * | 3/2007 | Kitozaki | 399/110 |
| 2007/0196149 | A1 | 8/2007 | Sato et al. | |

FOREIGN PATENT DOCUMENTS

| | | |
|---|---|---|
| EP | 0248682 | 12/1987 |
| EP | 1429199 | 6/2004 |
| JP | 08-171246 | 7/1996 |
| JP | 2004258453 | 9/2004 |

OTHER PUBLICATIONS

European Search Report dated Sep. 4, 2009 issued in EP Application No. 09156397.3.

Xerox Corp.—Evaluator Guide Xerox Workcentre Pro 245—XP002542225—Dec. 31, 2005.

* cited by examiner

*Primary Examiner* — Hoang Ngo
(74) *Attorney, Agent, or Firm* — Stanzione & Kim, LLP

(57) ABSTRACT

An image forming apparatus includes a main body in which a cassette unit to accommodate a plurality of sheets of paper, a toner cartridge unit to contain toner, an imaging unit to flow into the toner contained in the toner cartridge unit, a transfer unit which transfers an image formed by the imaging unit onto the paper, and a waste toner collection unit to collect waste toner discharged from the imaging unit and the transfer unit, and a control panel unit to receive user commands, wherein at least four of the cassette unit, the toner cartridge unit, the imaging unit, the transfer unit, the waste toner collection unit, and the control panel unit are disposed so as to be accessed by a user in the same direction.

17 Claims, 13 Drawing Sheets

IMAGE FORMING APPARATUS

CROSS-REFERENCE TO RELATED APPLICATIONS

This application claims priority under 35 U.S.C. §119 (a) from Korean Patent Application No. 10-2008-0040530, filed on Apr. 30, 2008, in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a cover structure which enables users to easily replace expendables or components which are mounted in an image forming apparatus.

2. Description of the Related Art

High-speed and high-end devices generally have many optional components, so the number of components which must be replaced, attached or detached by users or service engineers is relatively large.

For example, such optional components may include a developing unit which develops images, a toner cartridge which supplies toner to the developing unit, an intermediate transfer belt unit which forms an image by overlapping four color toners, a waste toner collection unit which collects waste toner generated in the intermediate transfer belt or a photoconductive body, a paper feeding cassette which supplies paper, and a finisher which performs post-processing (stapling, folding, rotating, offsetting, pasting or punching) of printed paper. These optional components are frequently used in the business-to-business (B2B) market or corporate printers, and the use frequency thereof is likely to increase.

When designing an image forming apparatus in order to mount these option components, the paper feeding cassette and the developing unit may be attached or detached on the front of the image forming apparatus so that access by users is easy, and the intermediate transfer unit may be attached or detached to a side of the image forming apparatus, and other components such as the waste toner collection unit may be attached or detached in different diverse directions.

The reason that optional components are disposed to be accessible by the user in different directions is that the user cannot easily access important components or careful components and only service engineers having expertise can install or replace such components.

There is a recent trend that large devices which require replacement of diverse components are designed to be replaced directly by the user rather than be maintained and repaired by service engineers. Accordingly, each replaceable component is modularized and the structure of the image forming apparatus is improved in order for users to have easy access.

However, even if replaceable component are modularized, if attachment and detachment of each replaceable component are made in different directions, users having no expertise may not know in which direction each component is attached or detached, and the user must take the time to learn this for each component.

In addition, since one side of the image forming apparatus is generally disposed adjacent to a wall or other object, when optional components are attached or detached in the direction to the wall or other object, the image forming apparatus must be moved in order to attach or detach the optional components.

In addition, if option components are designed to be attached or detached in diverse directions, covers which are opened and closed to attach or detach in diverse directions have to be installed so that there is a space for installation and for an increased numbers of components to be considered as well as design restrictions.

In addition, if covers are designed to be opened and closed in diverse directions, a space and components for each cover, a space and components for opening or closing each cover, and a space and components for fixing each cover are required, with the result that the size of the image forming apparatus becomes larger and the structure becomes more complicated.

Furthermore, in order to open and close the covers in diverse directions, a space over a certain size must be secured so that the space for using the image forming apparatus is significantly wider than the space for installing the image forming apparatus, so space usage is inefficient.

SUMMARY OF THE INVENTION

The present general inventive concept provides an image forming apparatus in which components which are frequently replaced or detached are disposed so that they may be easily accessed by a user, and so the user can intuitively recognize the direction to access a replaceable component.

In addition, the present general inventive concept provides an image forming apparatus, the structure of which is simplified in order that diverse components may be replaced by merely opening a single cover so that operation for assembly and replacement is simplified.

In addition, the present general inventive concept provides an image forming apparatus having an improved structure so that access by stages is enabled considering the replacement frequency or care when replacing a component, so frequently replaced components ensures the maximum user convenience and infrequently replaced components, which may malfunction when users having no expertise access, are accessed by stages using a security means.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a main body in which a cassette unit to accommodate a plurality of sheets of paper, a toner cartridge unit to contain toner, an imaging unit to flow into the toner contained in the toner cartridge unit, a transfer unit which transfers an image formed by the imaging unit onto the paper, and a waste toner collection unit to collect waste toner discharged from the imaging unit and the transfer unit, and a control panel unit to receive user commands, wherein at least four of the cassette unit, the toner cartridge unit, the imaging unit, the transfer unit, the waste toner collection unit, and the control panel unit are disposed so as to be accessed by a user in the same direction.

The direction in which the user accesses the at least four components may be from the front of the main body.

The main body may further include a scan unit to read out a document, and the scan unit is disposed to be manipulated in the direction in which the user accesses.

The cassette unit, the toner cartridge unit, the imaging unit, the transfer unit, and the waste toner collection unit may have a sliding rail structure to be attached and detached in the same direction.

The toner cartridge unit and the waste toner collection unit may be exposed by opening a first cover disposed on the main body so as to be opened and closed, the imaging unit and the transfer unit may be exposed by opening a second cover disposed in the main body so as to be opened and closed so that the second cover is exposed after opening the first cover, the first cover and the second cover may be disposed in the same plane, and the toner cartridge unit, the imaging unit, the transfer unit, and the waste toner collection unit may be disposed to be attached and detached in the same direction by the user.

The main body may further include a finisher unit to perform post-processing of a printed paper such as stapling, folding, rotating, offsetting, pasting, binding, or punching, wherein the finisher unit includes a finisher cover for maintenance disposed separately with the first cover in the same direction in which the user accesses.

The foregoing and/or other aspects and utilities of the present general inventive concept may also be achieved by providing a control method of an image forming apparatus including a toner cartridge unit to contain toner, an imaging unit to flow into the toner contained in the toner cartridge unit, and a transfer unit which transfers an image formed by the imaging unit onto the paper, wherein the toner cartridge unit, the imaging unit, and the transfer unit are disposed to be attached or detached in the same direction.

The image forming apparatus may further include a waste toner collection unit to collect waste toner discharged from the imaging unit and the transfer unit, wherein the waste toner collection unit is disposed to be attached or detached in the same direction as the toner cartridge unit, the imaging unit, and the transfer unit.

The image forming apparatus may further include a cassette unit to accommodate a plurality of sheets of paper, wherein the cassette unit is disposed to be attached or detached in the same direction as the toner cartridge unit, the imaging unit, and the transfer unit.

The image forming apparatus may further include a control panel unit to manipulate the image forming apparatus, wherein the control panel unit is disposed to be accessed in the same direction as the toner cartridge unit, the imaging unit, and the transfer unit.

The cassette unit, the toner cartridge unit, the imaging unit, the transfer unit, and the waste toner collection unit may have a sliding rail structure to be attached and detached in the same direction.

The toner cartridge unit and the waste toner collection unit are exposed by opening a first cover disposed on the main body so as to be opened and closed, the imaging unit and the transfer unit may be exposed by opening a second cover disposed in the main body so as to be opened and closed so that the second cover is exposed after opening the first cover, the first cover and the second cover may be disposed in the same plane, and the toner cartridge unit, the imaging unit, the transfer unit, and the waste toner collection unit may be disposed to be attached and detached in the same direction by the user.

The image forming apparatus may further include a finisher unit to perform post-processing of a printed paper such as stapling, folding, rotating, offsetting, pasting, binding, or punching, wherein the finisher unit includes a finisher cover for maintenance disposed separately with the first cover in the same direction in which the user accesses the toner cartridge unit, the imaging unit, the transfer unit, and the waste toner collection unit.

The same direction may be a direction of the front of the image forming apparatus.

The foregoing and/or other aspects and utilities of the present general inventive concept may be achieved by providing an image forming apparatus, including a plurality of replaceable components detachable from a front side thereof, and a first cover to open and close at the front side of the image forming apparatus to access and replace the plurality of replaceable units therethrough.

The image forming apparatus may further include a second cover to open and close at the front side of the image forming apparatus within the first cover such that at least one of the plurality of replaceable units can be accessed and replaced only upon opening both the first cover and the second cover.

The second cover and replaceable units including plural toner cartridges and a waste toner collection unit are accessible and replaceable upon opening the first cover. The replaceable units accessible and replaceable only upon opening both the first cover and the second cover may include an imaging unit and a transfer unit.

BRIEF DESCRIPTION OF THE DRAWINGS

These and/or other aspects and utilities of the present general inventive will become apparent and more readily appreciated from the following description of the embodiments, taken in conjunction with the accompanying drawings of which.

DETAILED DESCRIPTION OF THE PREFERRED EMBODIMENTS

Figure 1:
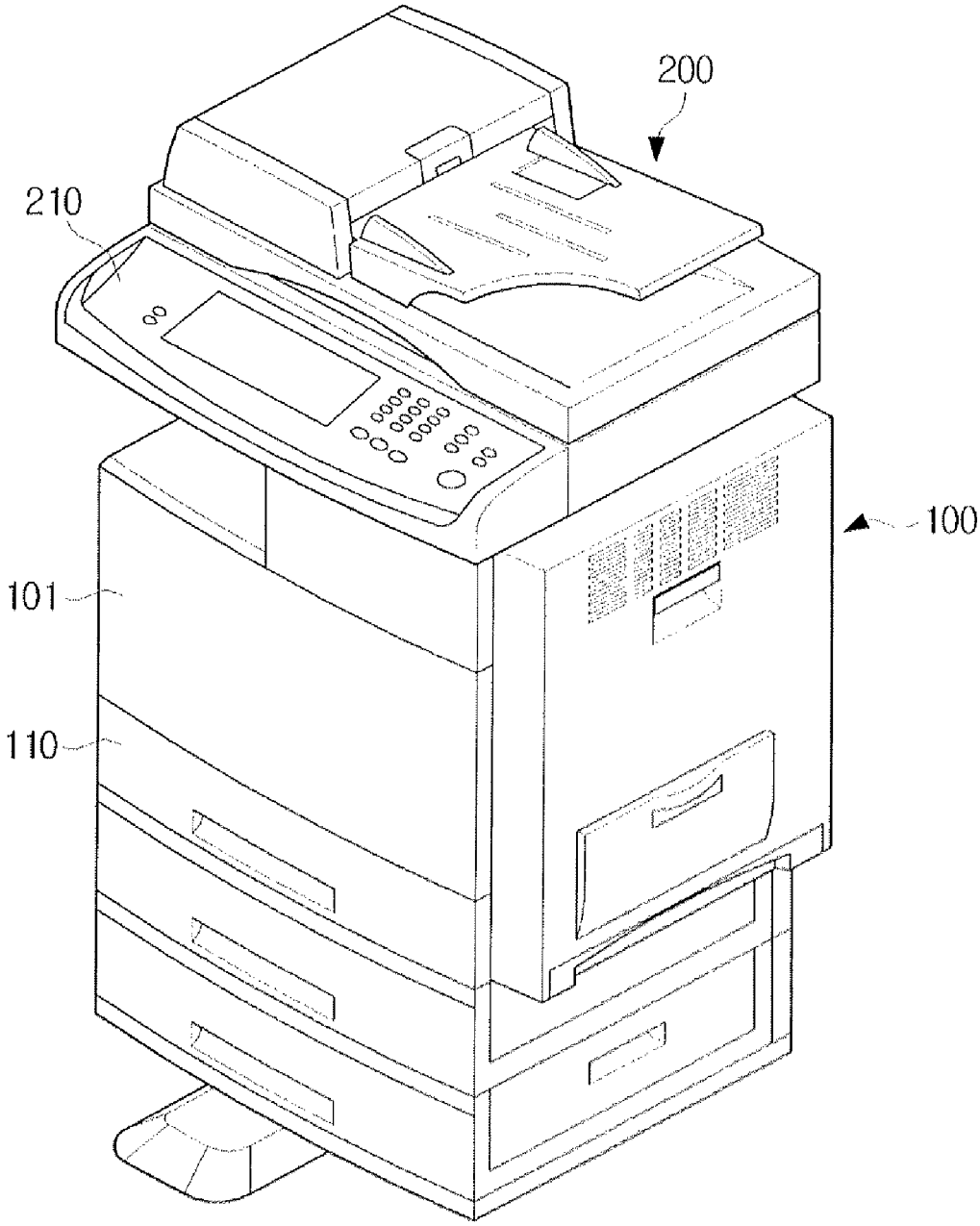
FIG. 1 is a perspective view illustrating an image forming apparatus according to an exemplary embodiment of the present general inventive concept.

Reference will now be made in detail to the present embodiments of the present general inventive concept, examples of which are illustrated in the accompanying drawings, wherein like reference numerals refer to like elements throughout. The embodiments are described below in order to explain the present general inventive concept by referring to the figures.

FIG. 1 illustrates a multifunctional peripheral having copying, scanning, and printing functions as an example of an image forming apparatus.

An image forming apparatus according to an exemplary embodiment of the present general inventive concept includes a main body 100 in which components to print are mounted, and a scan unit 200 which is disposed on the upper side of the main body 100 in order to read out a document.

Figure 2:
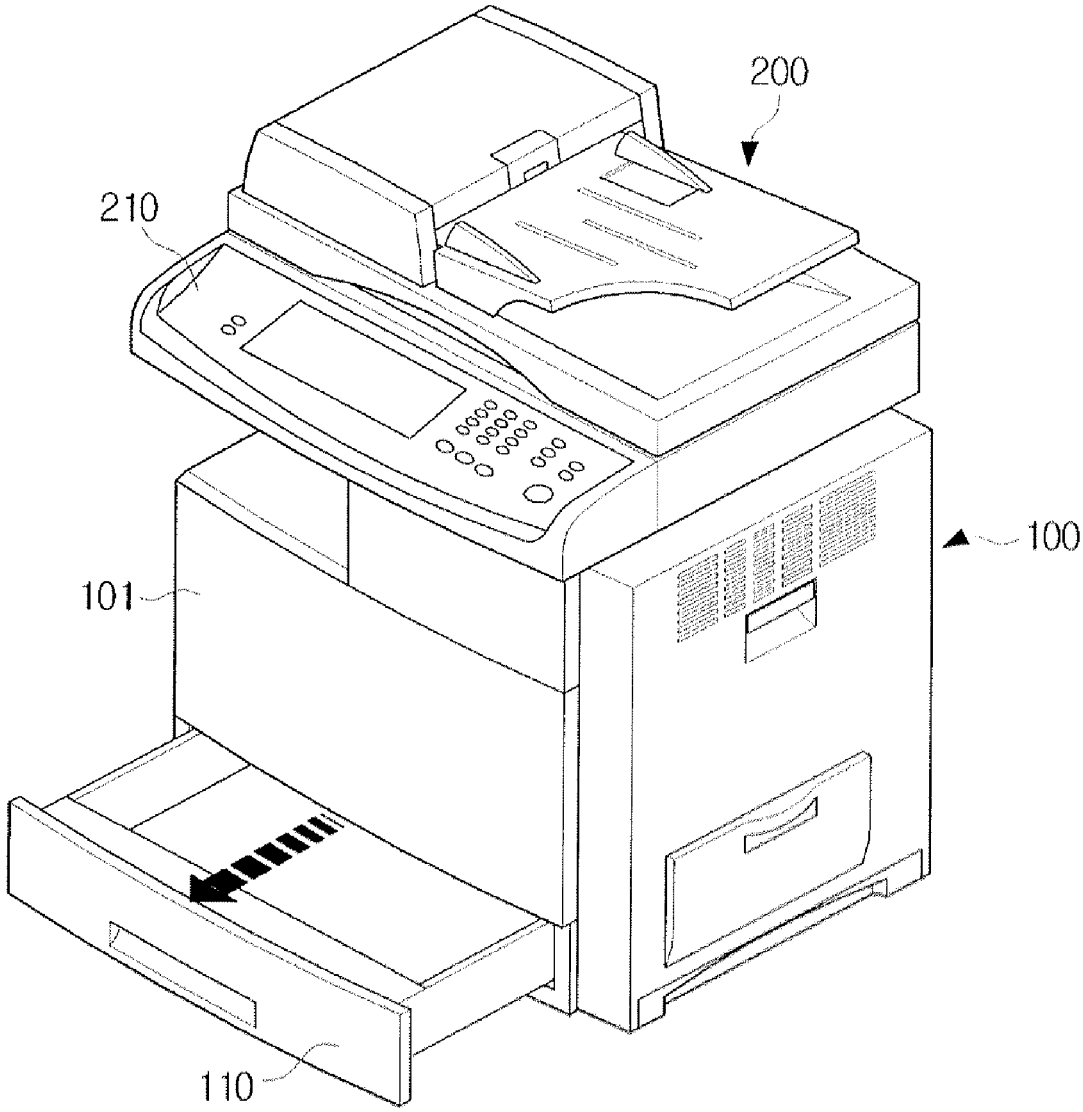
FIG. 2 is a perspective view illustrating a direction in which a paper feeding cassette of FIG. 1 is opened and closed.

A paper feeding cassette 110 to accommodate paper is formed to be slidably opened and closed at the lower side of the main body 100 of the image forming apparatus. The paper feeding cassette 110 may be provided in a single unit as illustrated in FIG. 2, or in a plurality of units which are sequentially stacked as illustrated in FIG. 1. In particular, the paper feeding cassette 110 may be slidably opened and closed in the front direction of the image forming apparatus in which users mainly access.

The scan unit 200 is disposed on the top of the main body 100 so that the user can copy or scan a document. The scan unit 200 includes a control pad unit 210 which controls the operation of the scan unit 200 and the main body 100, a scan cover 201 which is formed to be opened and closed upwards, and a flat plate 202.

Figure 3:
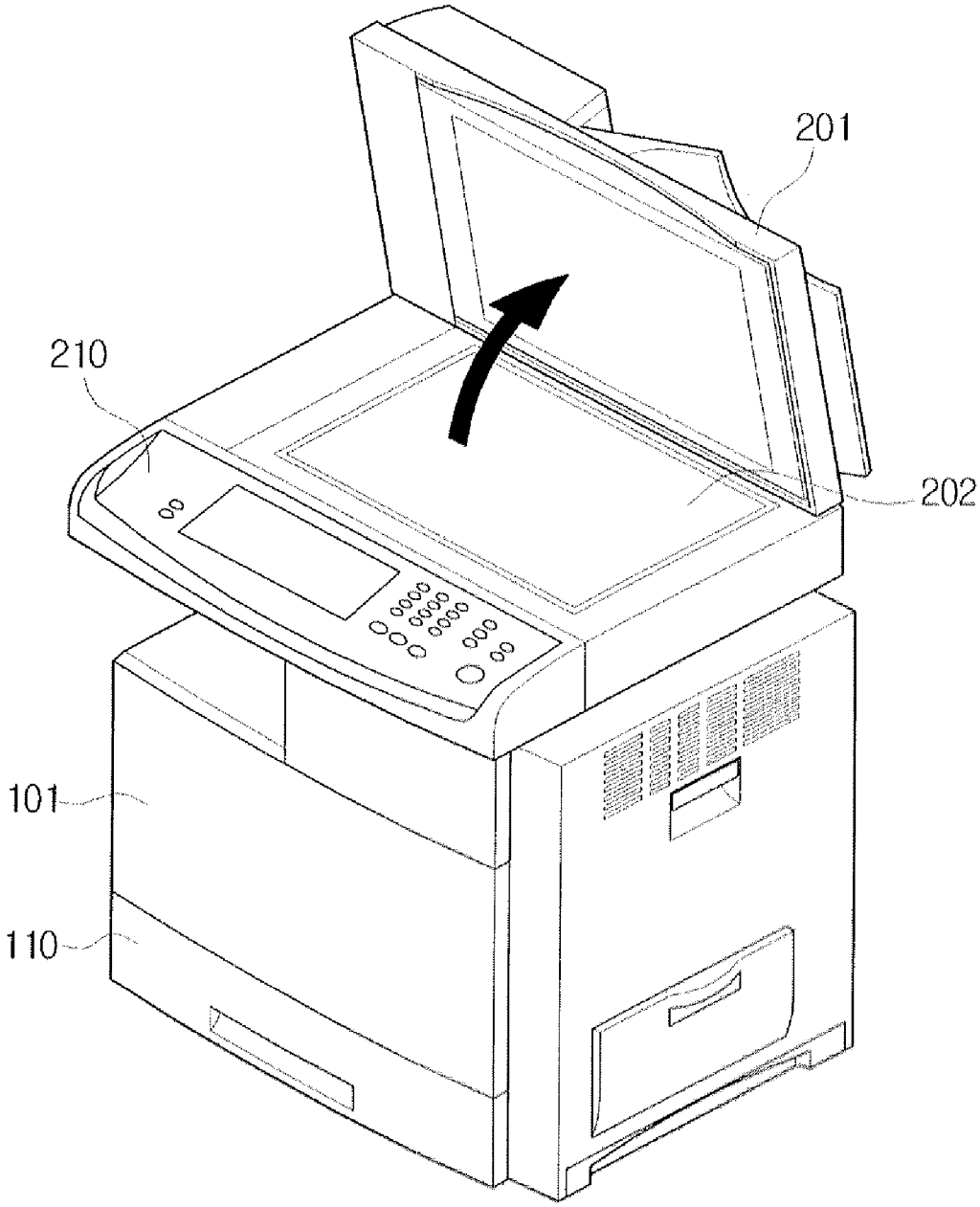
FIG. 3 is a perspective view illustrating a method of using a scan unit when scanning or copying a sheet of paper.
Figure 4:
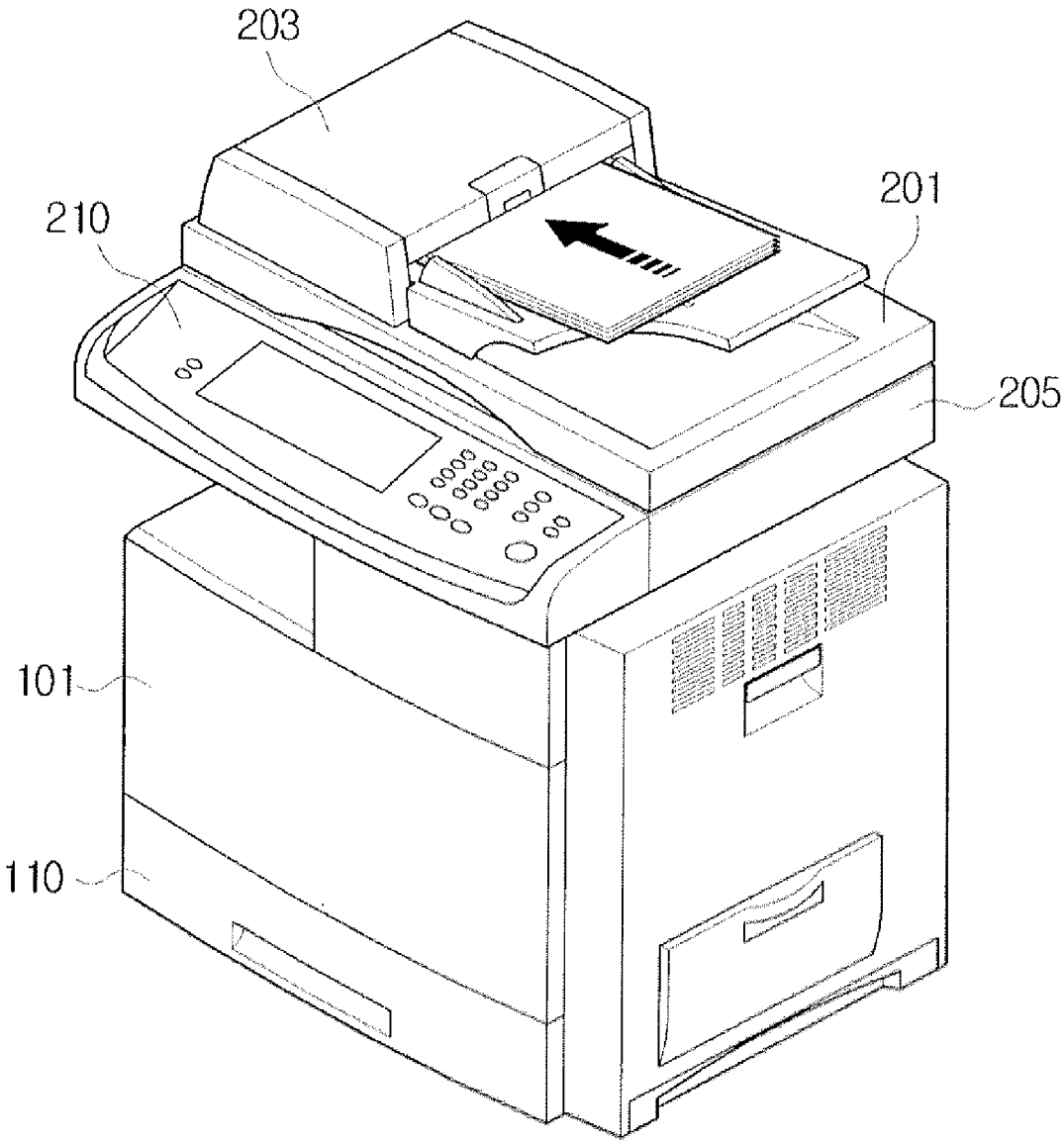
FIG. 4 is a perspective view illustrating a method of performing an operation using an ADF when scanning or copying a plurality of sheets of paper.

Accordingly, if a sheet of paper is copied or scanned as illustrated in FIG. 3, the scan cover 201 is lifted in a direction indicated by the arrow, the document is laid down on the flat plate 202, and copying or scanning is performed. In order to scan or copy a plurality of sheets of paper successively, the document is laid down on an auto document feeder (ADF) 203 as illustrated in FIG. 4, and successive copying or scanning is performed.

The control panel unit 210 may be formed on a front part of the scan unit 200 so that the user can easily access the control panel unit 210, and in an exemplary embodiment of the present general invention concept, the control panel unit 210 may be formed on a main body 205 of the scan unit 200, in which components such as a charge-coupled device (CCD) module (not shown) and a driving device are mounted.

FIGS. 5 to 8 illustrate the inside of the main body 100. As illustrated, a toner cartridge 120, an imaging unit 130, a transfer unit 140, and a waste toner collection unit 150 are disposed as components to print above the paper feeding cassette 110 in the main body 100, and are protected by a first cover 101 which is formed to be opened and closed at the front of the main body 100.

Figure 5:
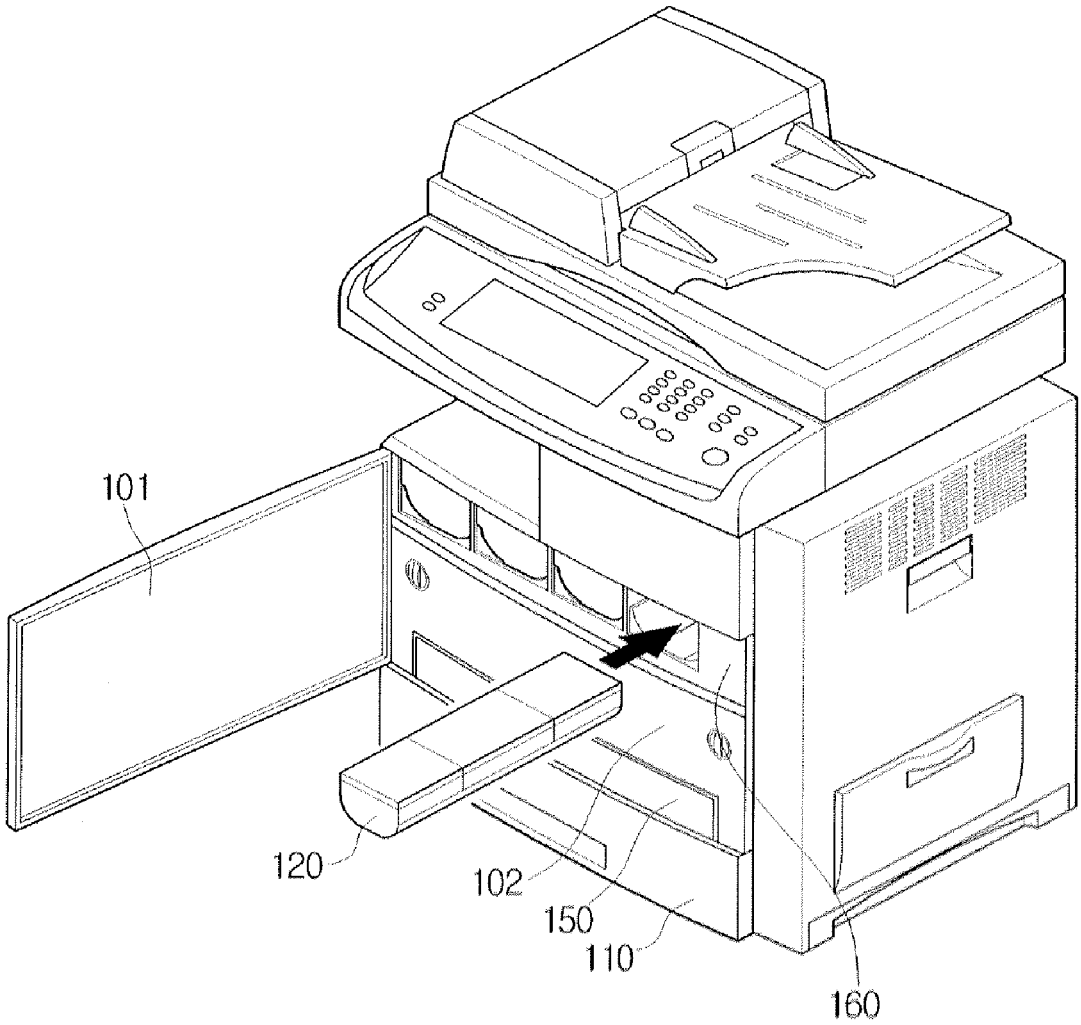
FIG. 5 is a perspective view illustrating a method of opening a first cover which is formed on the front of the image forming apparatus and replacing a toner cartridge.
Figure 6:
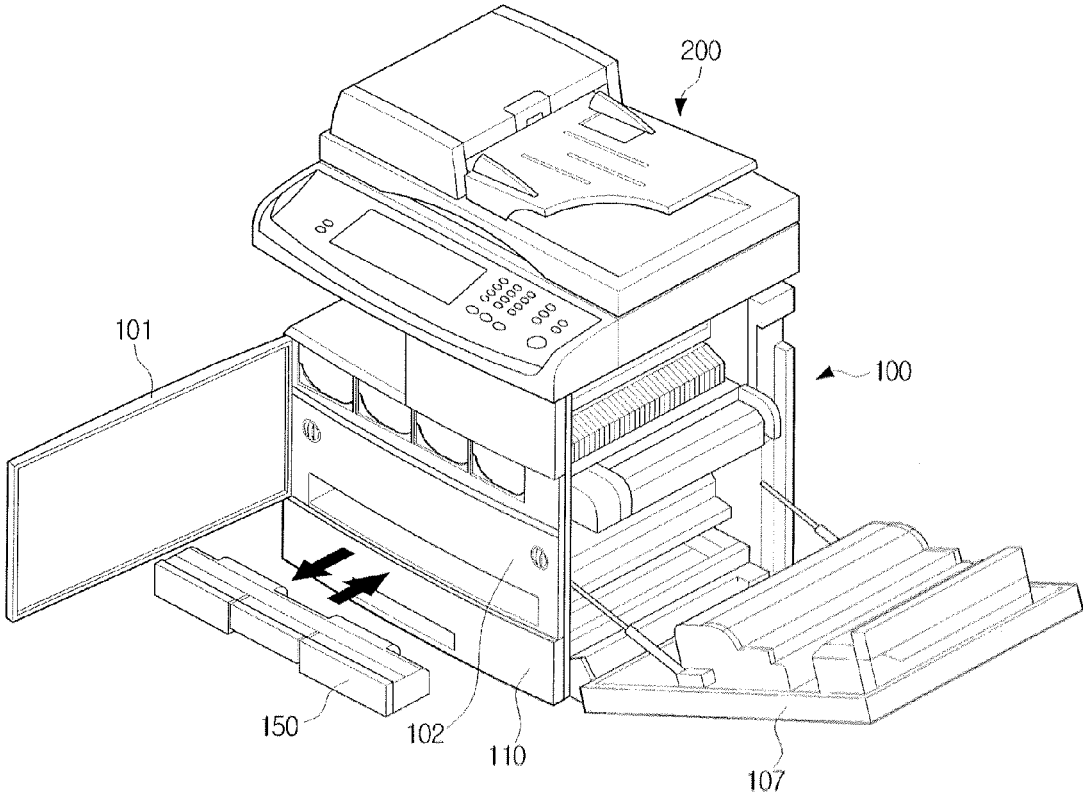
FIG. 6 is a perspective view illustrating a method of opening a first cover which is formed on the front of the image forming apparatus and opening a side cover in order to pull out a waste toner collection unit or remove jammed paper.

The first cover 101 is formed at the front of the image forming apparatus so that the user can easily access and open and close the first cover 101. If the first cover 101 is opened, the toner cartridge 120, the waste toner collection unit 150, and a second cover 102, which protects the imaging unit 130 and the transfer unit 140, are exposed as illustrated in FIGS. 5 and 6.

The first cover 101 may be opened and closed by right or left rotation, and by only opening the first cover 101, most of the components mounted in the main body 100 are exposed. To this end, the first cover 101 may form a part of the exterior of the main body 100.

If the first cover 101 is opened, the user can easily access, detach and attach the toner cartridge 120 and the waste toner collection unit 150. The reason that the accessibility to the toner cartridge 120 and the waste toner collection unit 150 is made easy is that these are components to be frequently replaced. Specifically, if toner in the toner cartridge 120 is exhausted, the toner cartridge 120 needs to be replaced immediately, and if the waste toner collection unit 150 is full of waste toner, the waste toner collection unit 150 must be replaced. That is, the toner cartridge 120 and the waste toner collection unit 150 are components which do not require the user's expertise for replacement and attachment.

By contrast, the imaging unit 130 and the transfer unit 140 may be protected by the second cover 102 so that even if the first cover 101 is opened, the user cannot access the imaging unit 130 and the transfer unit 140. Specifically, the imaging unit 130 and the transfer unit 140 can be attached or detached only when the second cover 102 is opened.

The reason that the imaging unit 130 and the transfer unit 140 are protected by the second cover 102 is so the user cannot easily access the imaging unit 130 and the transfer unit 140. If users having no expertise in dealing with the imaging unit 130 and the transfer unit 140, malfunctioning of the image forming apparatus or inflow of foreign substance may occur. Therefore, the imaging unit 130 and the transfer unit 140 may be disposed as far as possible from the reach of the user. However, if it is too difficult to access the imaging unit 130 and the transfer unit 140, a service engineer must be used to do so, so it is preferable to expose the imaging unit 130 and the transfer unit 140 using the second cover 102 in addition to the first cover 101.

The transfer unit 140 may be a belt assembly corresponding to the imaging unit 130 for each color, is interposed between the toner cartridge 120 and the imaging unit 130, and is exposed by opening the second cover 102. The transfer unit 140 can include a tension control device (not shown) so that when the transfer unit 140 is detached from the image forming apparatus, the tension control device enables the transfer unit 140 to be easily released by loosening the tension of the transfer belt. According to this structure, the transfer unit 140 may be detached in a direction perpendicular to a direction in which paper is transferred. If the transfer unit 140 is attached or detached in the paper transferring direction or the direction perpendicular to the paper transferring direction without the tension control device, the transfer unit 140 may be damaged. In particular, if the transfer unit 140 is detached in the direction perpendicular to the paper transferring direction as in the present general inventive concept, the transfer belt may be damaged by paper when the paper is jammed. Therefore, it is important to remove the transfer unit 140 from the image forming apparatus by releasing tension of the transfer belt, so it is preferable to make the tension control device operate in association with opening and closing the second cover 102.

Figure 7:
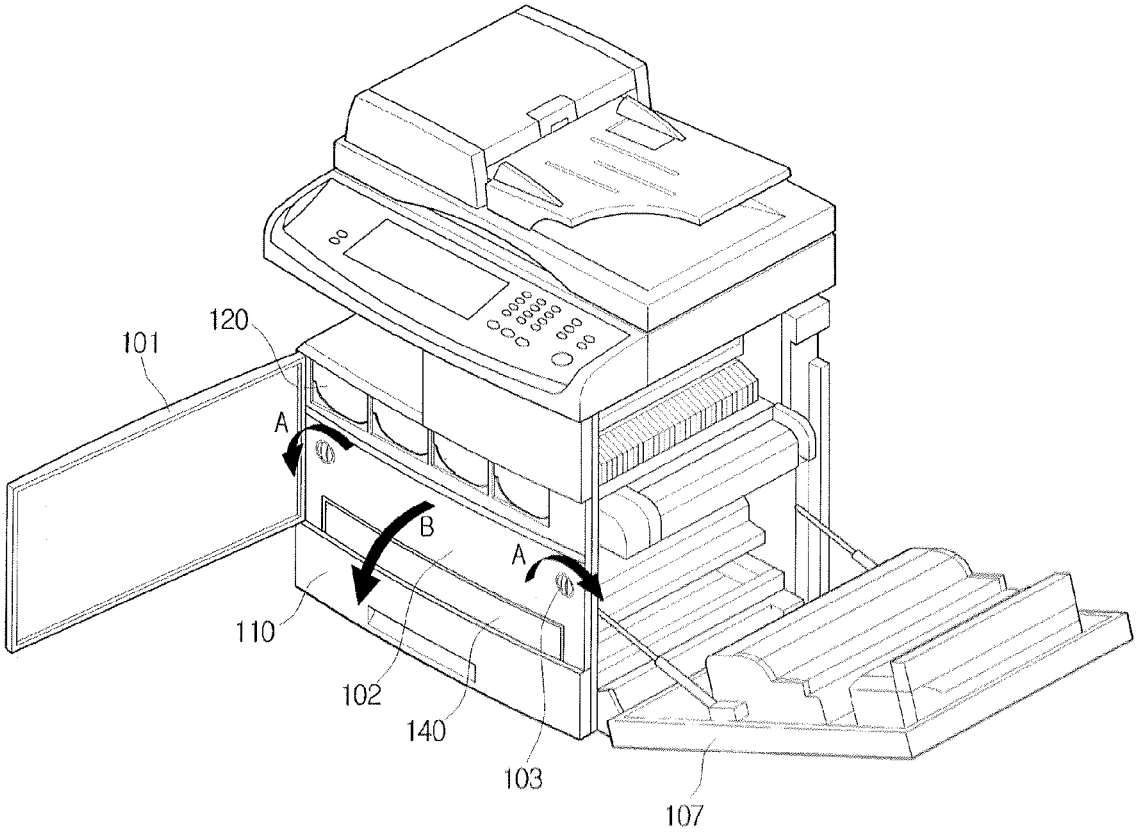
FIG. 7 is a perspective view illustrating a method of releasing locking of a second cover in order to expose an imaging unit and a transfer unit.
Figure 8:
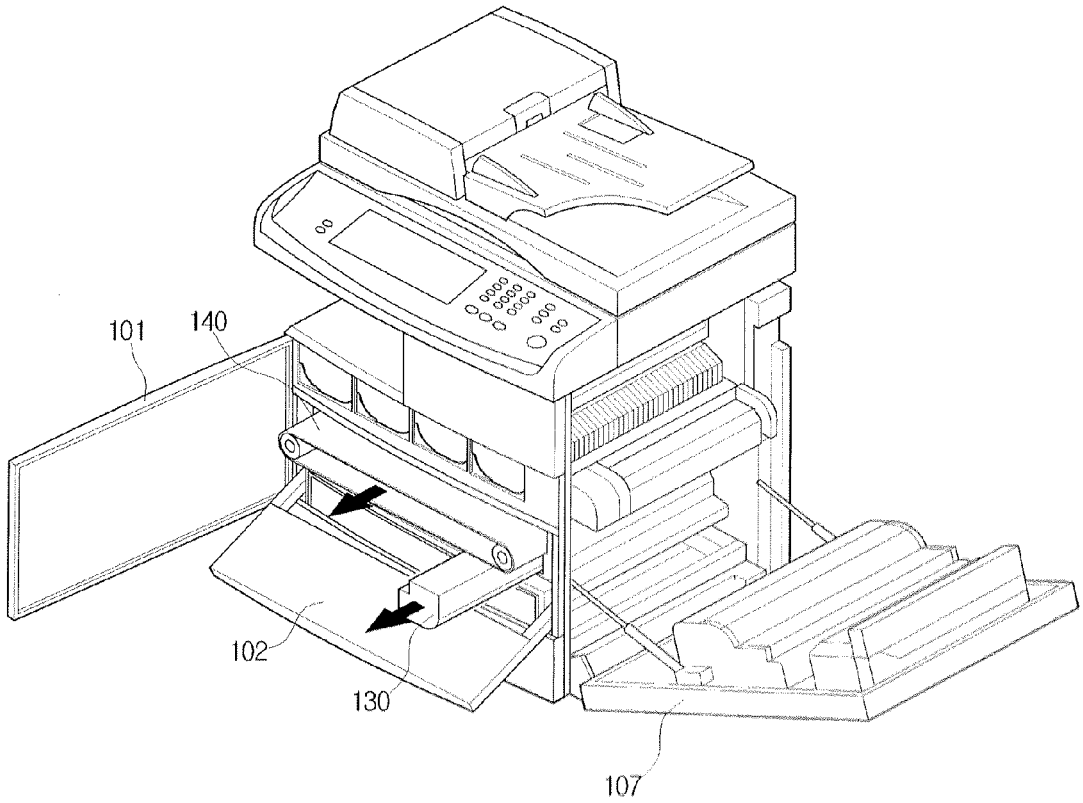
FIG. 8 is a perspective view illustrating a method of opening the second cover as illustrated in FIG. 7 and removing the imaging unit and the transfer unit.

As illustrated in FIGS. 7 and 8, the second cover 102 is detachably formed on the main body 100 so that the second cover 102 can be opened using at least two rotation locking handles 103. In addition, since the second cover 102 is disclosed on the same plane as the first cover 101, the user can open and close the second cover 102 in the front of the image forming apparatus. If the rotation locking handles 103 formed on the second cover 102 are rotated in the "A" direction as indicated using arrows (see FIG. 7), locking between the second cover 102 and the main body 100 is released and the user can open the second cover 102 in the "B" direction as indicated using an arrow.

As described above, since the first and second covers 101 and 102 are formed on the same plane of the main body 100, particularly, at the front of the image forming apparatus, which is easily accessed by the user, the user can perform replacement and repair of most components only by opening the first and second covers 101 and 102.

As illustrated in FIGS. 6 to 8, a third cover 107 is formed to be able to be opened and closed in order to expose the right side of the main body 100 so that jammed paper can be removed. When paper picked up from the paper feeding cassette 110 is jammed on the paper transfer path or printed paper is jammed around a fixing unit (not shown), the user can open the third cover 103 and remove the jammed paper. The third cover 103 may be formed by opening and closing one entire side of the main body 100.

In addition, since the image forming apparatus is generally disposed close to a wall or a corner, if the first and second covers 101 and 102 are positioned at the front of the image forming apparatus, inconvenience of moving the image forming apparatus for maintenance can be avoided.

In addition, the toner cartridge 120 and the waste toner collection unit 150, which need to be frequently accessed by the user, can be accessed simply by opening the first cover 101, and the imaging unit 130 and the transfer unit 140, which do not need to be frequently accessed by the user, can be protected by the second cover 102. As a result, user convenience and device security can be ensured.

Figure 9:
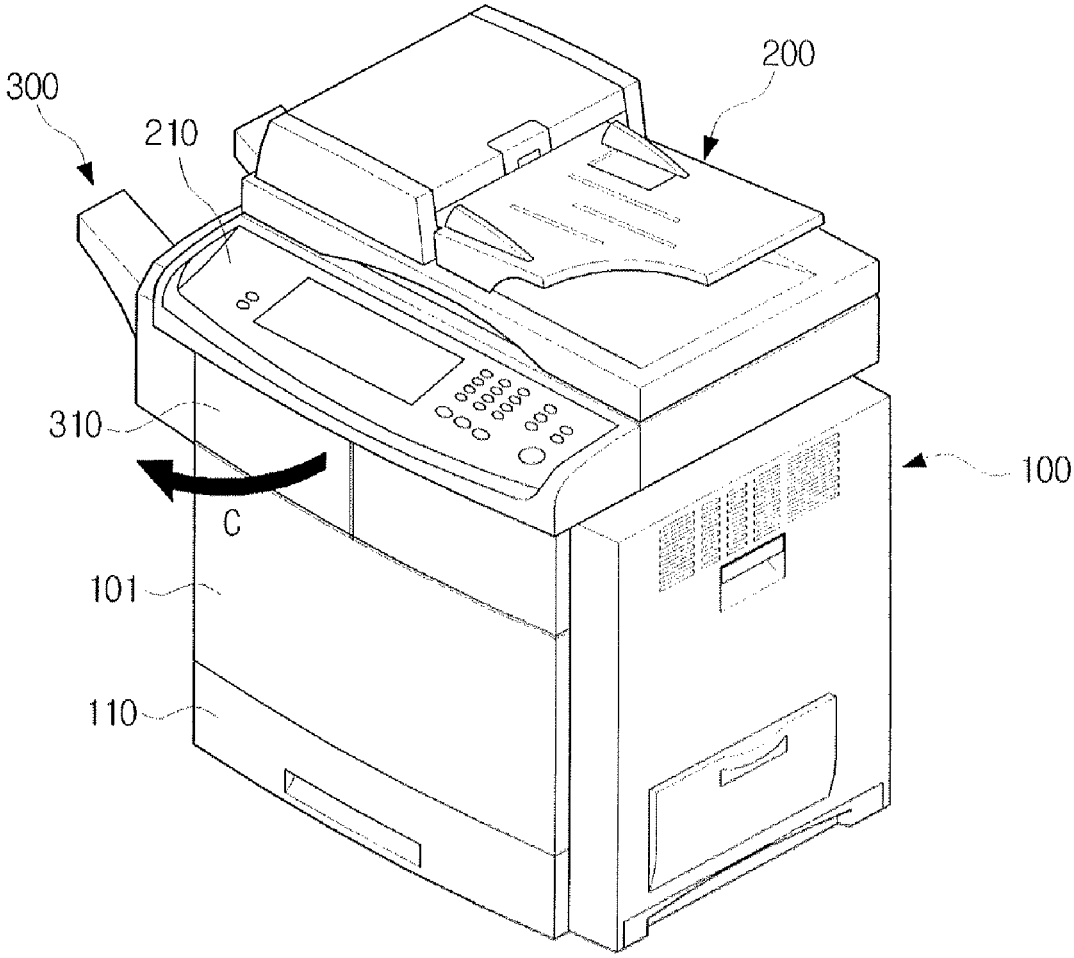
FIGS. 9 and 10 are perspective views illustrating a method of opening the first cover and a finisher cover including separate components in order to expendables of a finisher unit in an image forming apparatus including the finisher unit.
Figure 10:
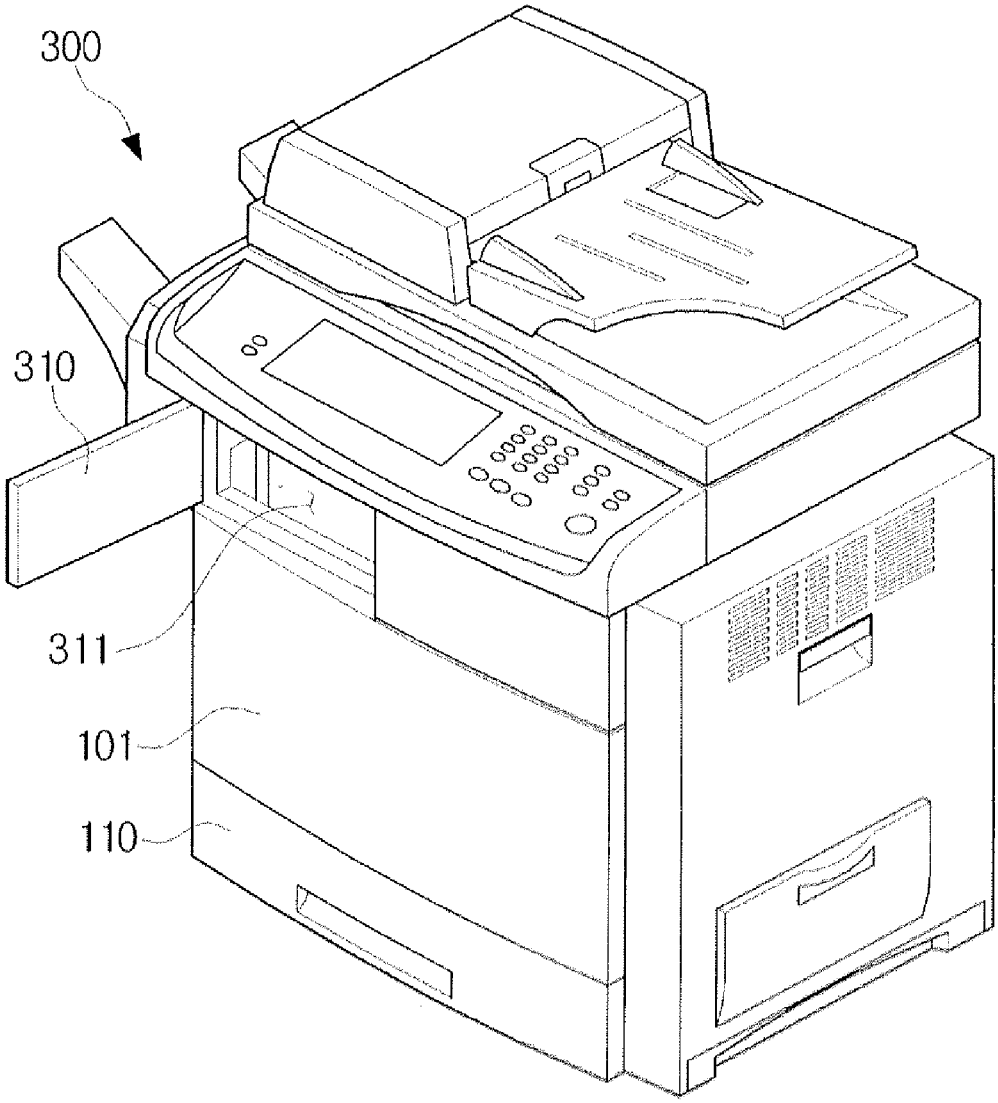

FIGS. 9 and 10 illustrate an image forming apparatus having a finisher unit 300, which post-processes completely printed or copied paper, according to another exemplary embodiment of the present general inventive concept.

The finisher unit 300 performs post-processing for completely printed paper, such as stapling, folding, rotating, offsetting, pasting, binding, and punching. As illustrated in FIGS. 9 and 10, a finisher cover 310 for maintenance is disposed on the front of the main body 100 to be opened and closed separately with the first cover 101.

The finisher cover 310 is made to be opened and closed separately with the first cover 101 in order to prevent a portion of a replacement module of the finisher unit 300, such as stapler pins, punched paper, or remaining bond from entering the imaging unit 130 or the transfer unit 140. Therefore, contamination of images and malfunctioning of the image forming apparatus can be prevented.

Figure 11A:
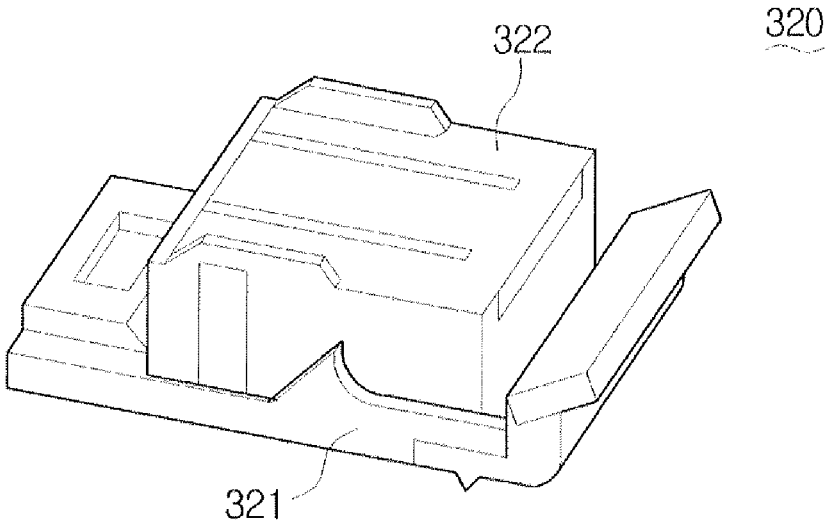
FIGS. 11A and 11B illustrate a stapler replacement module which is an example of an expendable detachably mounted in the finisher unit.
Figure 11B:
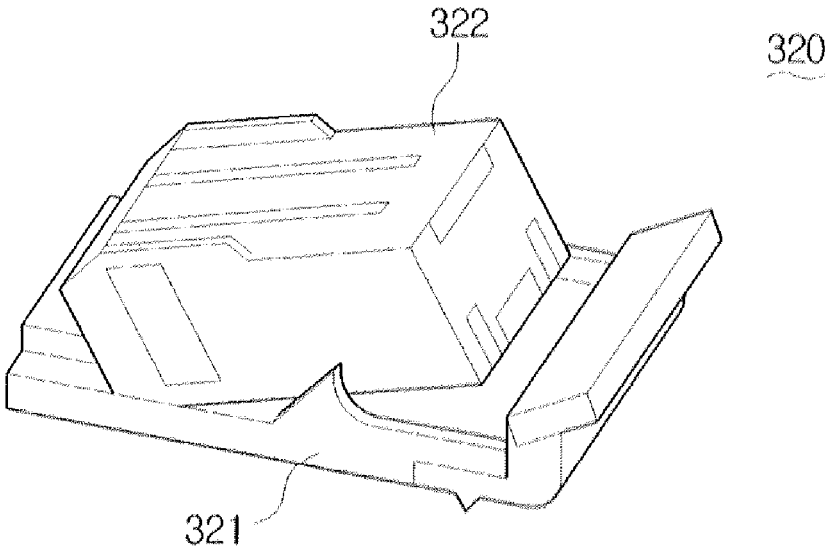

FIGS. 11A and 11B illustrate a stapler replacement module 320 which is an example of an expendable detachably mounted in the finisher unit 300.

As illustrated in FIGS. 11A and 11B, the stapler replacement module 320 includes a replacement module base 321 which is inserted into a mounting groove 311 of the finisher unit 300, and a stapler holder 322 which is detachably mounted in the replacement module base 321. Stapler pins (not shown) are accommodated in the stapler holder 322, and if the stapler pins are exhausted, the user pulls the replacement module base 321 from the mounting groove 311, separates the stapler holder 322 from the replacement module base 321 as illustrated in FIG. 11B, and supplements stapler pins.

Figure 12:
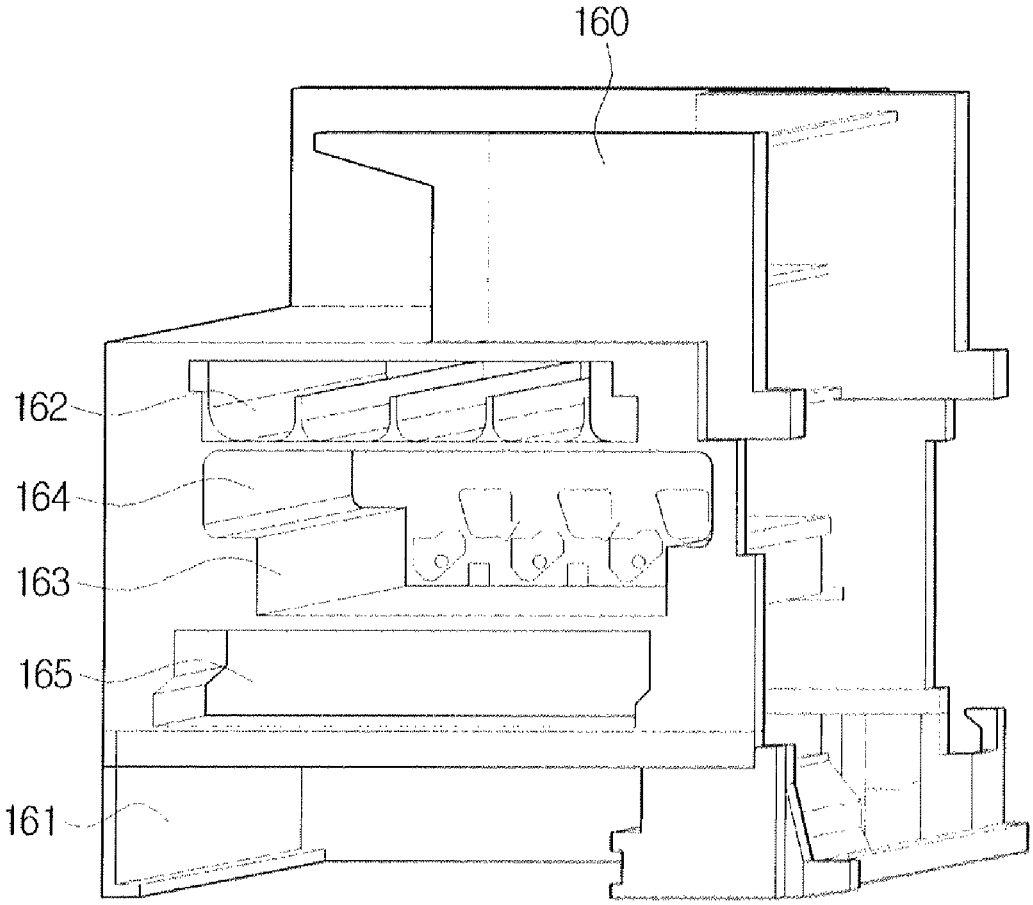
FIG. 12 is a perspective view illustrating a frame of the image forming apparatus.

FIG. 12 is a perspective view illustrating a frame of the main body 100 of the image forming apparatus. As illustrated in FIG. 12, the frame 160 includes first to fourth guide rails 161 to 164 each which guide the paper feeding cassette 110, the toner cartridge 120, the imaging unit 130, the transfer unit 140, and the waste toner collection unit 150 to be slid in the same direction. The first to fourth guide rails 161 to 164 may include rollers in order to promote sooth sliding, or may be formed in the same shape as each corresponding component as illustrated in FIG. 12.

Figure 13:
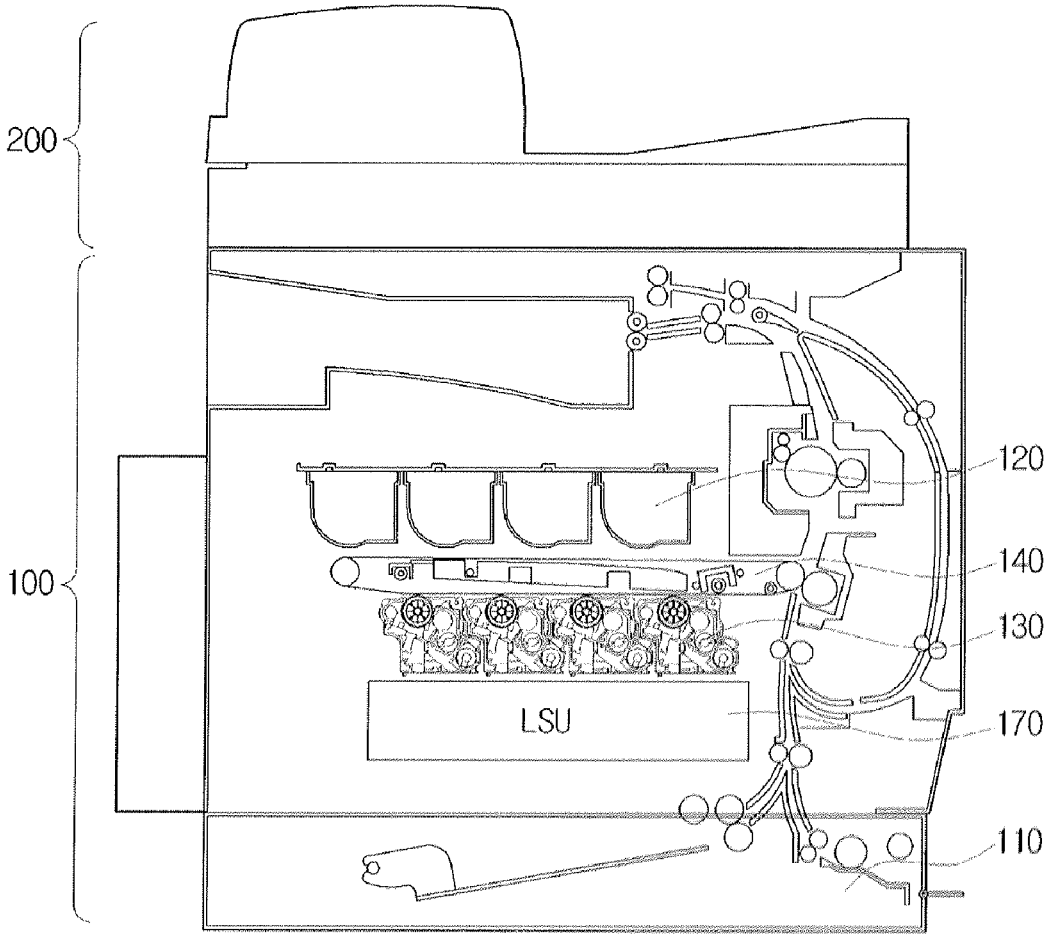
FIG. 13 is a sectional view schematically illustrating a structure of the image forming apparatus.

FIG. 13 is a sectional view schematically illustrating a structure of the image forming apparatus. As illustrated in FIG. 13, the imaging unit 130, the transfer unit 140, and the toner cartridge 120 are sequentially disposed on the paper feeding cassette 110, and the scan unit 200 for copying and scanning a document is disposed on the top of the image forming apparatus. The waste toner collection unit 150 and a light emitting unit 170, which exposes the imaging unit 130 to light, may be interposed between the imaging unit 130 and the paper feeding cassette 110.

Such a disposition may be changed according to the configuration of the image forming apparatus, but the disposition described above may be preferable for miniaturization if the image forming apparatus has copying and scanning functions and is a large office multifunctional peripheral.

In the exemplary embodiment of the present general inventive concept, most replacement components are attached to and detached from on the front of the image forming apparatus, which the user can easily access, but it is not limited thereto. Most replacement components can be made to be attached to and detached from in any directions other than the front. For example, the first cover 101 may be disposed on the right or left side of the main body 100, taking into consideration the paper transfer direction or the movement of the user, and the replacement components may be attached and detached in the same direction as the first cover 101.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a main body in which a cassette unit to accommodate a plurality of sheets of paper, a plurality of toner cartridge units to contain toner having different colors respectively, a plurality of imaging units, each imaging unit to receive toner from the respective toner cartridge unit and to form an image on a transfer unit;

a control panel unit to receive user commands and accessible from a front side of the image forming apparatus;

a cassette unit movably attached to the main body so as to be accessible from the front side of the image forming apparatus;

a first cover attached to the main body and movable between an opened position and a closed position;

a second cover attached to the main body and movable between an opened position and a closed position; and a waste toner collection unit to collect waste toner discharged from the plurality of imaging units and the transfer unit, wherein the plurality of toner cartridge units, the waste toner collection unit and the second cover are accessible from the front side of the image forming apparatus when the first cover is in the opened position, and wherein the plurality of imaging units and the transfer unit are accessible from the front side of the image forming apparatus when both the first cover and the second cover are in the opened position.

2. The image forming apparatus according to claim 1, further comprising:

a scan unit disposed on a top portion of the main body to read out a document, wherein the control panel unit is located at a front side of the scan unit.

3. The image forming apparatus according to claim 1, wherein the cassette unit is mounted to the main body via a sliding rail structure so as to be attached and detached from a front direction.

4. The image forming apparatus according to claim 1, wherein the waste toner collection unit is accessible from the front side of the image forming apparatus when the first cover is in the opened position.

5. The image forming apparatus according to claim 4, further comprising:

a finisher unit disposed in the main body to perform post-processing of a printed paper such as stapling, folding, rotating, offsetting, pasting, binding, or punching, wherein the finisher unit comprises a finisher cover movable between an opened position and a closed position for maintenance thereof, the finisher cover disposed separately from the first cover.

6. An image forming apparatus, comprising:

a first cover and a second cover both movable from an opened position to a closed position;

a plurality of toner cartridge units to contain toner, each toner cartridge unit having a different color;

a plurality of imaging units, each imaging unit to receive the toner from the toner cartridge unit;

a transfer unit to transfer an image formed thereon by the plurality of imaging units onto a paper, and a waste toner collection unit to collect waste toner discharged from the plurality of imaging units and the transfer unit, wherein the plurality of toner cartridge units, the waste toner collection unit and the second cover are accessible from a front side of the image forming apparatus when the first cover is in the opened position, and wherein the plurality of imaging units and the transfer unit are accessible from the front side of the image forming apparatus when both the first cover and the second cover are in the opened position.

7. The image forming apparatus according to claim 6, further comprising:

a cassette unit to accommodate a plurality of sheets of paper, wherein the cassette unit is accessible from the front side of the image forming apparatus when the first cover is in the opened position.

8. The image forming apparatus according to claim 7, further comprising:

a control panel unit to manipulate the image forming apparatus, wherein the control panel unit is disposed to be accessible from the front side of the image forming apparatus.

9. The image forming apparatus according to claim 8, wherein the cassette unit, the toner cartridge unit, the imaging unit, the transfer unit, and the waste toner collection unit have a sliding rail structure so as to be attached and detached from a front direction.

10. The image forming apparatus according to claim 9, wherein the waste toner collection unit is accessible from the front side of the image forming apparatus when the first cover is in the opened position.

11. The image forming apparatus according to claim 10, further comprising a finisher unit to perform post-processing of a printed paper such as stapling, folding, rotating, offsetting, pasting, binding, or punching, wherein the finisher unit comprises a finisher cover movable between an opened position and a closed position for maintenance thereof, the finisher cover disposed separately from the first cover.

12. The image forming apparatus according to claim 11, wherein the front direction is a direction of the front side of the image forming apparatus.

13. An image forming apparatus, comprising:

a plurality of replaceable units detachable from a front side thereof; and a first cover and a second cover to open and close at the front side of the image forming apparatus to access and replace the plurality of replaceable units, including a plurality of toner cartridge units and at least one of a waste toner collection unit, an imaging unit, and a transfer unit, therethrough, wherein the plurality of toner cartridge units and the second cover are accessible from the front side when the first cover is opened, and wherein at least one of the plurality of replaceable units are accessible and replaceable from the front side when both the first cover and the second cover are opened.

14. The image forming apparatus according to claim 13, wherein the second cover and replaceable units including the plurality of toner cartridge units and the waste toner collection unit are accessible and replaceable upon opening the first cover.

15. The image forming apparatus according to claim 14, wherein the replaceable units accessible and replaceable upon opening both the first cover and the second cover include the imaging unit and the transfer unit.

16. A frame of an image forming apparatus, comprising:

a first guide rail to removably accommodate a toner cartridge unit which contains toner;

a second guide rail to removably accommodate an imaging unit which receives the toner from the toner cartridge unit to form an image;

a third guide rail to removably accommodate a transfer unit to transfer the image onto a printing medium; and a first cover to cover the toner cartridge unit, a second cover, and at least one of the imaging unit and the transfer unit, the first cover and second cover movable between an opened position and a closed position, wherein the toner cartridge unit and the second cover are accessible from a front side of the image forming apparatus when the first cover is opened, and wherein the imaging unit and the transfer unit are accessible from the front side of the image forming apparatus when both the first cover and second cover are opened.

17. The frame apparatus of claim 16, wherein the toner cartridge, the imaging unit, and the transfer unit are removed along a front direction.

* * * * *